United States Patent [19]

Oakes

[11] 4,161,073

[45] Jul. 17, 1979

[54] SNOW SCOOP

[76] Inventor: William Oakes, 104 State St., Newburyport, Mass. 01950

[21] Appl. No.: 848,395

[22] Filed: Nov. 4, 1977

[51] Int. Cl.[2] ..... E01H 5/02

[52] U.S. Cl. ..... 37/130; 294/55; 280/47.24

[58] Field of Search ..... 37/53, 130; 294/55, 294/53; 280/47.24, 47.26

[56] References Cited

U.S. PATENT DOCUMENTS

| | | | |
|---|---|---|---|
| 1,804,404 | 5/1931 | Dowling | 37/130 |
| 2,441,449 | 5/1948 | Shaw | 37/130 |
| 2,801,862 | 8/1957 | Parker et al. | 280/47.26 |
| 2,895,238 | 7/1959 | Long | 37/130 |
| 2,957,700 | 10/1960 | Beaurline | 280/47.24 X |
| 3,021,625 | 2/1962 | Stasse | 37/130 |
| 3,107,446 | 10/1963 | Messinger | 37/130 |
| 3,121,963 | 2/1964 | Nolan | 37/130 X |
| 3,242,598 | 3/1966 | Wright | 37/130 |
| 3,389,818 | 6/1968 | Rinehart | 280/47.26 X |
| 3,748,761 | 7/1973 | Chetwynde | 37/130 |

*Primary Examiner*—E. H. Eickholt
*Attorney, Agent, or Firm*—Jerry Cohen

[57] ABSTRACT

A snow scoop having a pair of wheels for support and an adjustable scoop angle. The scoop portion is foldable for easy storage when the device is not in use. Said scoop portion is adapted for attachment to a standard hand truck thereby converting the same into a wheel born snow scoop.

4 Claims, 3 Drawing Figures

SNOW SCOOP

BACKGROUND OF THE INVENTION

1. Field of the Invention

The field of this invention relates generally to devices adapted for snow removal. More specifically this invention relates to hand operated snow removal tools such as snow shovels and the like.

2. Description of the Prior Art

There are several different versions of the conventional snow shovel and some novel snow scoops present in the prior art and are typified by U.S. Pat. No. 2,933,836 to McKinle, however, all of these prior art devices require that the user at some point must lift or dump the snow out of the device requiring great exertion and effort. In addition all of the devices have some friction with ground which the user must overcome. These prior art devices are adapted for only a single purpose and finally, many are bulky devices which cannot easily be stored.

Accordingly, it is an object of this invention to provide a scoop which can be used for more purposes than simply a snow scoop.

It is a further object of this invention to provide a scoop which minimizes the effort required to empty the same.

It is a further object of this invention to provide a scoop which is easily storable when not in use.

SUMMARY OF THE INVENTION

The invention is primarily a snow scoop attachment for conventional hand trucks although the hand truck structure can be incorporated into a specialized scoop design as a single unit. The scoop of the instant invention is rotatably and slideably attached at the rear upright portion of a hand truck while the front portion is allowed to rest on the ground.

By sliding the scoop upwards on the upright of said hand truck the angle of incidence with the ground of said scoop can be changed such that the hand truck can be used to propell said scoop along the ground thereby lifting snow and the like from the ground. The wheels of the hand truck provide a fulcrum point about which the user may rotate the load in the scoop and transport the same to a dumping site with little effort because the weight of the load is balanced on said wheels. When said scoop is not in use it may be folded upwards against the upright of the hand truck and stored in a relatively small space.

Further, said scoop may also be used to enhance the hand truck operation when not used to scoop snow and the like by sliding the rear of the scoop downward to the bottom of the hand truck in this position the scoop becomes an extension of the foot of the hand truck and may be inserted under devices to be carried and thus extends the width of the hand truck foot.

DESCRIPTION OF THE PREFERRED EMBODIMENT

Figure 1:
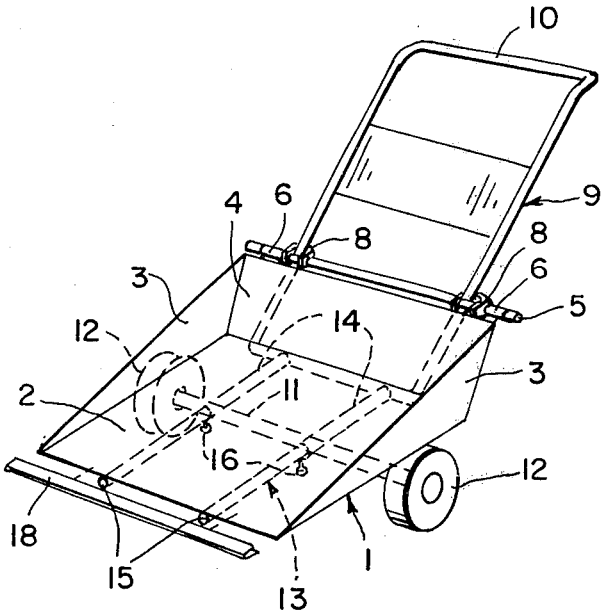
FIG. 1 is an objective view of the scoop in position on a modified hand truck.
Figure 3:
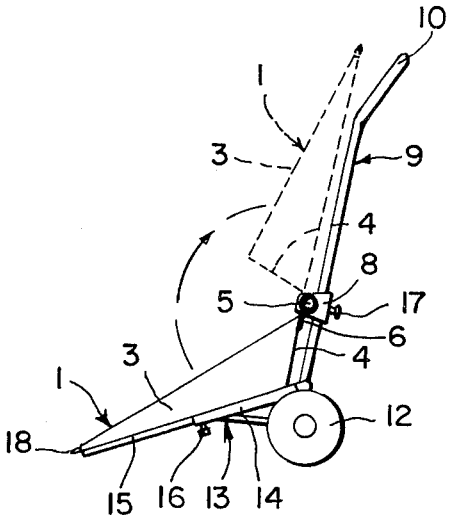
FIG. 3 is a side view of said scoop and hand truck in alternate positions of use and storage.
Figure 2:
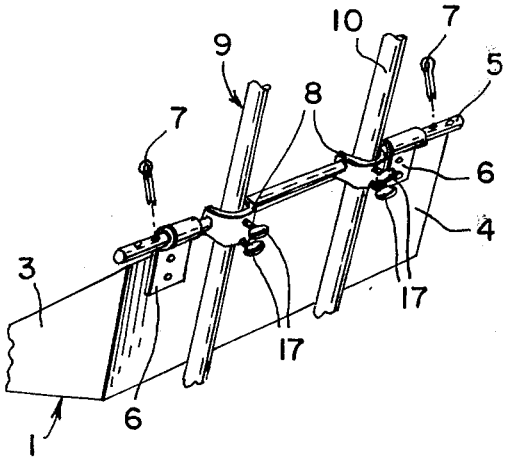
FIG. 2 is a rear view of the means of attachment to said truck.

With reference to the drawings, FIG. 1 shows a scoop 1 having a flat bottom portion 2, triangular sidewalls 3 and a back plate 4. Said scoop 1 is rotatably attached to an elongated bar 5 by a pair of hinge straps 6. Said hinge straps 6 are prevented from sliding off said bar 5 by cotter pins 7. Said bar 5 is rotatably received by a pair of U shaped brackets 8 for mounting on a hand truck assembly 9. Said scoop 1 is provided with a replaceable scoop blade 18.

Said truck assembly 9 may be a conventional tubular hand truck or a modified version as shown in the drawings. The hand truck shown comprises a tubular frame having a generally U shaped handle 10 depending from an axle 11. Said axle 11 supporting a pair of wheels 12. Depending oblique from said axle is a foot 13. Said foot 13 can either be the conventional U shaped tubular member attached by the arms to said handle 10 in a fixed position relative to said handle 10 with the bight of said U disposed away from said handle 10 or as shown in the drawing truncated such that the bight of the U is removed leaving only hollow tubes 14 depending from said handle. Said tubes 14 adapted for slideably receiving smaller tubes 15.

Thus, when scoop 1 is adjusted for any particular incident angle said tubes 15 may be adjusted to provide additional support under said scoop 1. Set screws 16 are provided to hold said tubes 15 in a fixed position relative to tubes 14.

U shaped brackets 8 receive bar 5 through holes in the arms of said U such that bar 5 is perpendicular to said arms. Said bracket is adapted for receiving the arms of the U shaped handle 10 of truck assembly 9 between the bight of said U and bar 5. Set screws 17 through the bight of U shaped brackets 8 engage said handle 10 at any position desired along said handle thus providing slideable adjustment along the length of said handle 10. Thus, the operation may be performed as outlined in the summary.

The foregoing is considered illustrative only of the principles and specific embodiment of the invention. Further, since numerous modifications and changes will readily occur to those skilled in the art, it is not intended to limit the invention to strictly that described herein but such is to include all modifications and equivalents falling within the scope of the invention herein claimed.

What is claimed is:

1. A snow scoop attachment comprising:
   (a) a scoop;
   (b) means for rotatably attaching said scoop to a frame; and
   (c) means for slideably attaching said scoop to said frame, and wherein said rotatable attaching means comprises:
      a plurality of strap hinges attached to said scoop;
      a bar rotatably received by said hinges; and
      a plurality of brackets adapted for receiving a frame and rotatably receiving said bar.

2. A snow scoop attachment as described in claim 1 wherein said slideable attachment means comprises:
   said brackets being U shaped and receiving said bar perpendicular to the arms of the U, and receiving said frame between said bar and the bight of said U; and
   a plurality of set screws for engaging said frame.

3. A snow scoop attachment comprising, a scoop, means for rotatably attaching said scoop to a frame, and means for slideably attaching said scoop to said frame, and wherein said frame comprises, a handle received by said slideable attaching means, an axle supporting said handle, a plurality of wheels rotatably attached to said axle, and a foot depending from said handle, and wherein said rotatable attaching means comprises, a plurality of strap hinges attached to said scoop, a bar rotatably received by said hinges, and a plurality of brackets adapted for receiving the handle of said frame and rotatably receiving said bar.

4. A combination as described in claim 3 wherein said slideable attaching means comprises:

said brackets being U shaped and receiving said bar perpendicular to the arms of the U, and receiving said frame between said bar and the bight of said U; and a plurality of set screws for engaging said frame.

* * * * *